US011035322B2

(12) United States Patent
Asanuma

(10) Patent No.: US 11,035,322 B2
(45) Date of Patent: Jun. 15, 2021

(54) PUMP MODULE, EVAPORATED FUEL PROCESSING DEVICE PROVIDED WITH PUMP MODULE, AND PUMP CONTROL CIRCUIT

(71) Applicant: AISAN KOGYO KABUSHIKI KAISHA, Obu (JP)

(72) Inventor: Daisaku Asanuma, Gamagori (JP)

(73) Assignee: AISAN KOGYO KABUSHIKI KAISHA, Obu (JP)

( * ) Notice: Subject to any disclaimer, the term of this patent is extended or adjusted under 35 U.S.C. 154(b) by 0 days.

(21) Appl. No.: 16/482,014

(22) PCT Filed: Dec. 27, 2017

(86) PCT No.: PCT/JP2017/047112
§ 371 (c)(1),
(2) Date: Jul. 30, 2019

(87) PCT Pub. No.: WO2018/146977
PCT Pub. Date: Aug. 16, 2018

(65) Prior Publication Data

US 2020/0003162 A1 Jan. 2, 2020

(30) Foreign Application Priority Data

Feb. 7, 2017 (JP) ..... JP2017-020746

(51) Int. Cl.
*F02M 25/00* (2006.01)
*F02M 25/08* (2006.01)
(Continued)

(52) U.S. Cl.
CPC ..... *F02M 25/08* (2013.01); *F02M 37/04* (2013.01); *F02D 41/266* (2013.01);
(Continued)

(58) Field of Classification Search
CPC ..... F02M 25/08; F02M 37/04; F04B 17/04; F02D 2200/0602; F02D 41/3082; F02D 41/266
See application file for complete search history.

(56) References Cited

U.S. PATENT DOCUMENTS 5,715,797 A * 2/1998 Minagawa ..... F02D 41/3082 123/497
6,161,423 A * 12/2000 Okuma ..... F02M 25/0818 123/520
(Continued)

FOREIGN PATENT DOCUMENTS

JP H09-310838 A 12/1997
JP H11-270418 A 10/1999
(Continued)

OTHER PUBLICATIONS

International Search Report for PCT/JP2017/047112 (with English translation) dated Mar. 27, 2018 (3 pages).
(Continued)

*Primary Examiner* — Phutthiwat Wongwian
*Assistant Examiner* — Sherman D Manley
(74) *Attorney, Agent, or Firm* — Shumaker, Loop & Kendrick, LLP

(57) ABSTRACT

A pump module includes a pump section that discharges evaporated fuel generated in a fuel tank to an intake path of an internal combustion engine. The pump module also stores correction information for correcting a rotation speed of the pump section based on a difference between a reference discharge characteristic of a reference pump section at a predetermined rotation speed and a discharge characteristic of the pump section at the predetermined rotation speed.

9 Claims, 6 Drawing Sheets

(51) Int. Cl.

| | |
|---|---|
| ***F02M 37/04*** | (2006.01) |
| *F02D 41/26* | (2006.01) |
| *F02D 41/30* | (2006.01) |
| *F04B 17/04* | (2006.01) |

(52) U.S. Cl.
CPC .. *F02D 41/3082* (2013.01); *F02D 2200/0602* (2013.01); *F04B 17/04* (2013.01)

(56) References Cited

U.S. PATENT DOCUMENTS

| | | | | |
|---|---|---|---|---|
| 7,213,584 | B2 | 5/2007 | Ohhashi et al. | |
| 7,284,530 | B2 | 10/2007 | Nagasaki et al. | |
| 7,350,399 | B2 | 4/2008 | Kobayashi et al. | |
| 2002/0162457 | A1* | 11/2002 | Hyodo | B01D 53/0454 96/109 |
| 2003/0221675 | A1* | 12/2003 | Washeleski | F02M 25/089 123/497 |
| 2006/0016253 | A1* | 1/2006 | Kobayashi | F02M 25/089 73/114.39 |
| 2006/0090553 | A1* | 5/2006 | Nagasaki | F02M 25/0836 73/114.43 |
| 2010/0089170 | A1* | 4/2010 | Reginaldo | F01P 11/18 73/861.11 |
| 2014/0299111 | A1* | 10/2014 | Denz | F02M 25/0836 123/521 |
| 2015/0159597 | A1* | 6/2015 | Woods | F02M 25/089 123/495 |
| 2016/0123254 | A1* | 5/2016 | Burleigh | F02D 41/004 123/520 |
| 2017/0152798 | A1* | 6/2017 | Casetti | F02D 41/1401 |
| 2017/0152813 | A1* | 6/2017 | Casetti | F02M 25/0809 |
| 2017/0152814 | A1* | 6/2017 | Casetti | F02M 25/0836 |
| 2019/0101082 | A1* | 4/2019 | Sanuma | F02D 41/0045 |
| 2019/0186393 | A1* | 6/2019 | Oh | F02M 35/10006 |
| 2019/0203666 | A1* | 7/2019 | Asanuma | F02M 37/22 |
| 2020/0003162 | A1* | 1/2020 | Asanuma | F02M 37/04 |

FOREIGN PATENT DOCUMENTS

| | | | |
|---|---|---|---|
| JP | 2002-213306 | A | 7/2002 |
| JP | 2005-188448 | A | 7/2005 |
| JP | 2006-037752 | A | 2/2006 |
| JP | 2006-132324 | A | 5/2006 |
| JP | 2007-278094 | A | 10/2007 |

OTHER PUBLICATIONS

Written Opinion (English translation) for PCT/JP2017/047112 dated Mar. 27, 2018 (9 pages).

* cited by examiner

PUMP MODULE, EVAPORATED FUEL PROCESSING DEVICE PROVIDED WITH PUMP MODULE, AND PUMP CONTROL CIRCUIT

TECHNICAL FIELD

The present specification relates to a pump module, an evaporated fuel processing device comprising the pump module, and a pump control circuit.

BACKGROUND ART

Japanese Patent Application Publication No. 2002-213306 (hereinafter referred to as Patent Literature 1) discloses a evaporated fuel processing device. In Patent Literature 1, evaporated fuel adsorbed by a canister is supplied to an intake path of an internal combustion engine using a pump. Use of a pump allows to supply purge gas (gas including evaporated fuel) to the intake path without depending on a pressure in the intake path.

SUMMARY OF INVENTION

When evaporated fuel is supplied to an internal combustion engine, it is necessary to control a flow rate of the evaporated fuel supplied to the internal combustion engine in order to control an air-fuel ratio of the internal combustion engine to a predetermined value. One of means for controlling the flow rate of evaporated fuel is a rotation speed of a pump, that is, the rotation speed of the pump is controlled on an assumption that a specific flow rate of evaporated fuel is supplied to the internal combustion engine when the pump is driven at a specific rotation speed. However, there is an individual difference in discharge performance among pumps. Therefore, even in a case of a same type of a pump, there are cases when more or less evaporated fuel is discharged for a specific rotation speed than planned. The present specification discloses a technique that reduces impact of individual differences in discharge performance among pumps on a discharge amount of evaporated fuel.

A pump module disclosed herein may include a pump section and a pump circuit section. The pump section is configured to discharge evaporated fuel generated in a fuel tank to an intake path of an internal combustion engine. The pump circuit section comprises a storage storing correction information for correcting a rotation speed of a pump section based on a difference between a reference discharge characteristic of a reference pump section at a predetermined rotation speed and a discharge characteristic of the pump section at the predetermined rotation speed.

As to the above pump module, since each pump module stores the correction information, when receiving a signal for driving at a specific rotation speed from a control circuit, each pump module can correct the rotation speed for each pump module, and send a same amount of evaporated fuel as a discharge amount of the reference pump section to the intake path of the internal combustion engine. Therefore, even if there is an individual difference in discharge performances of pump sections, the pump module can discharge a desired amount of evaporated fuel in response to a specific input signal from the control circuit.

An evaporated fuel processing device disclosed herein may comprise a canister, a purge path, a control valve, and the pump module as described above. The canister may be configured to adsorb evaporated fuel evaporated within the fuel tank. The purge path may be connected between the intake path of the internal combustion engine of a vehicle and the canister and through which purge gas sent from the canister to the internal combustion engine passes. The control valve may be disposed on the purge path between the intake path and the canister, and may be configured to switch between a communication state in which the intake path and the canister are in communication with each other and a shut-off state in which communication between the intake path and the canister is shut off. The pump module may be disposed on a gas flow path upstream of the control valve and may be configured to discharge the purge gas from the canister to the intake path. The evaporated fuel processing device disclosed herein can deliver a desired amount of evaporated fuel to the internal combustion engine regardless of individual difference among pump modules. It should be noted that the pump module needs only to be disposed on the gas flow path upstream of the control valve, may be disposed on purge path downstream of the canister, or may be disposed on an atmosphere path upstream of the canister (a path communicating the canister with atmosphere).

The present specification also discloses a pump control circuit. The pump control circuit is configured to control a pump section configured to discharge evaporated fuel generated in a fuel tank to an intake path of an internal combustion engine. The pump control circuit comprises a storage and a controller. The storage stores correction information for correcting a rotation speed of the pump section based on a difference between a reference discharge characteristic of a reference pump section at a predetermined rotation speed and a discharge characteristic of the pump section at the predetermined rotation speed. When receiving a signal for driving the pump section at a specific rotation speed, the controller is configured to correct a received specific rotation speed using the correction information, and drive the pump section at a corrected rotation speed. By using this pump control circuit, a desired amount of evaporated fuel can be discharged in response to a specific input signal from the control circuit even if there is an individual difference in discharge performances of pump sections.

DETAILED DESCRIPTION

Embodiments

Figure 1:
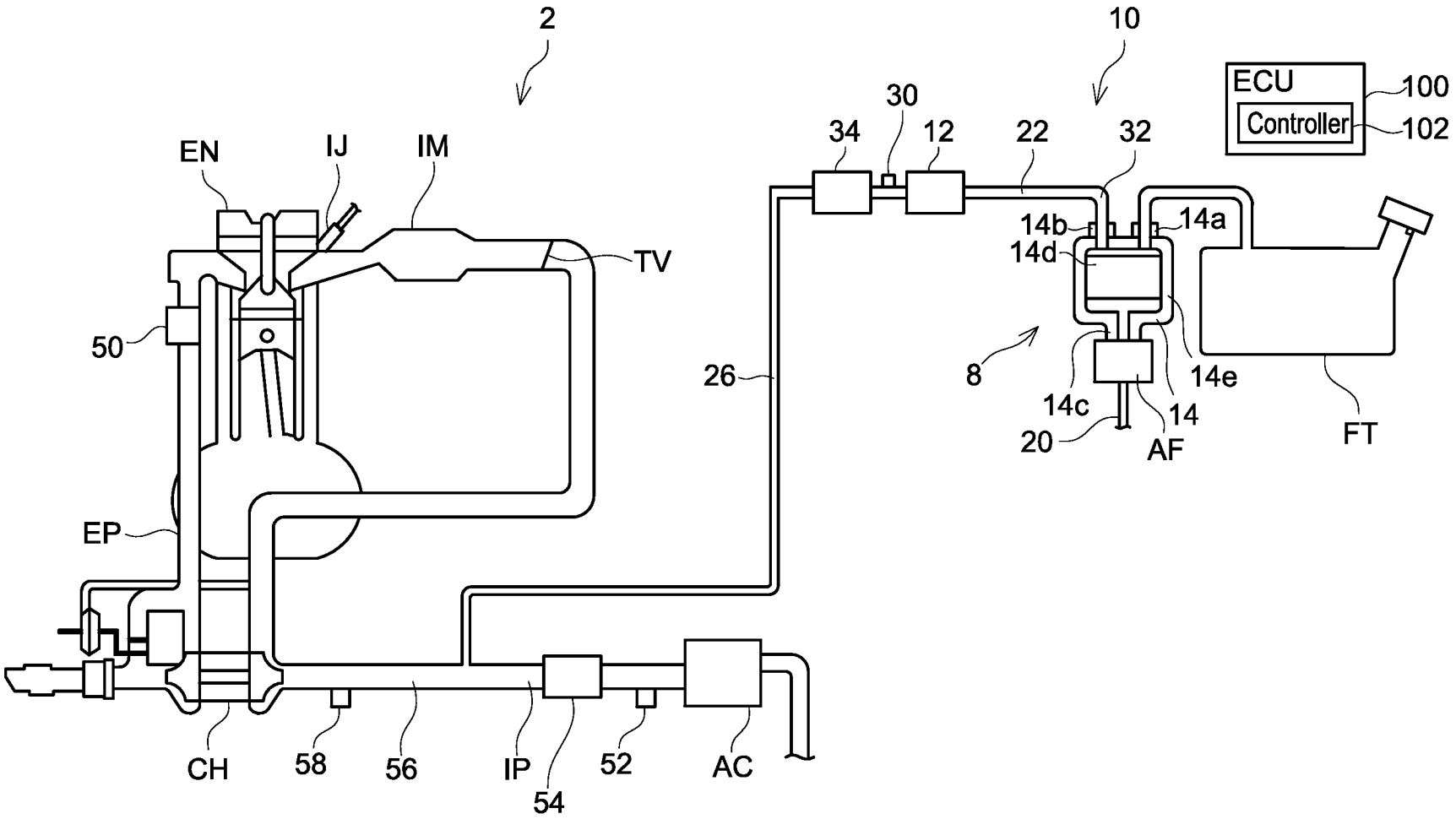
FIG. 1 shows an overview of an internal combustion engine system.

Some of technical features disclosed herein are listed below. The technical elements described below are independent technical elements, and exhibit technical usefulness alone or in various combinations.

The present specification discloses a pump configured to discharge evaporated fuel generated in a fuel tank to an intake path of an internal combustion engine. The pump may comprise a pump section that performs mechanical operations for discharging evaporated fuel, and a pump circuit section that controls a rotation speed (output rotation speed) of the pump section. That is, the pump may be a pump module comprising a pump section and a pump circuit section. The pump circuit section may be separate from the pump section. That is, the pump may be constituted of the pump section that performs mechanical operations for discharging evaporated fuel, and the pump circuit section that controls the rotation speed of the pump section may constitute another pump control circuit different from the pump (pump section).

The pump section (pump module) may constitute an evaporated fuel processing device. The evaporated fuel processing device may comprise a canister, a purge path, a control valve, and a pump section (pump module). The canister may adsorb evaporated fuel evaporated in a fuel tank. The evaporated fuel may be adsorbed by activated carbon disposed within the canister. The purge path may be connected between the intake path of the internal combustion engine of a vehicle and the canister. The canister may be connected to an atmospheric path one end of which is open to atmosphere. Purge gas (gas including evaporated fuel) delivered from the canister to the internal combustion engine may pass through the purge path. The control valve may be connected to the purge path between the intake path and the canister. The control valve may switch between a communication state in which the intake path and the canister are in communication with each other, and a shut-off state in which communication between the intake path and the canister is shut off. The pump section (pump module) may be arranged on a gas flow path upstream of the control valve. The pump section may be disposed on a gas flow path (purge path) between the control valve and the canister (upstream of the control valve and downstream of the canister), or may be disposed on a gas flow path (atmospheric path) upstream of the canister. The pump section may discharge purge gas from the canister to the intake path.

The pump circuit section may be connected to a control circuit that controls the pump module. The pump circuit section may be configured to drive the pump section based on a signal received from the control circuit (a signal for driving at a specific rotation speed), and to output a drive state (rotation speed) of the pump section to the control circuit. The pump circuit section may comprise a storage and a controller. The storage may store a reference discharge characteristic of a reference pump section at a predetermined rotation speed. The storage may store the reference discharge characteristics at a plurality of rotation speeds. The storage may store a discharge characteristic of a corresponding pump section (pump section controlled by a pump circuit section) at a predetermined rotation speed. The storage may store discharge characteristics of the corresponding pump section at a plurality of rotation speeds.

The storage may store correction information for correcting the rotation speed (output rotation speed) of the corresponding pump section based on a difference between the reference discharge characteristic and the discharge characteristic of the corresponding pump section. The storage may store the correction information corresponding to each of a plurality of predetermined rotation speeds. The storage may store a function obtained from the correction information corresponding to each of the plurality of predetermined rotation speeds. The correction information may be, for example, information obtained by measuring the discharge characteristics of each pump module when pump modules are manufactured, creating based on those measurement results, and storing in the storage. It is possible to suppress individual difference in discharge performance of pump modules from an early stage of using the pump (pump module).

The correction information may be a discharge amount correction coefficient c (c=a/b) indicated as a ratio of a discharge amount a of the corresponding pump section at a predetermined rotation speed to a reference discharge amount b of the reference pump section at the predetermined rotation speed. Alternatively, the correction information may be a plurality of discharge amount correction coefficients c calculated at a plurality of predetermined rotation speeds. Alternatively, the correction information may be a discharge amount correction function created using the plurality of discharge amount correction coefficients c.

The correction information may be a discharge amount group including reference discharge amounts (b1, b2, . . . ) of the reference pump section at a plurality of predetermined rotation speeds for calculating a reference discharge amount b of the reference pump section at a specific rotation speed, and discharge amounts (a1, a2, . . . ) of the corresponding pump section at the plurality of predetermined rotation speeds for calculating a discharge amount a of the corresponding pump section at the specific rotation speed. Alternatively, the correction information may be a discharge amount function group including a reference discharge amount function created using a plurality of "reference discharge amounts b1, b2, . . . " and a discharge amount function created using a plurality of "discharge amounts a1, a2, . . . ".

The correction information may be corresponding rotation speeds where the rotation speed of the reference pump section for discharging a specific flow rate and the rotation speed of the corresponding pump section for discharging the specific flow rate are corresponded to each other. The correction information may be corresponding rotation speeds at a plurality of specific flow rates. Alternatively, the correction information may be a corresponding rotation speed function created using a plurality of corresponding rotation speeds.

When the controller receives a signal for driving the corresponding pump section (pump module) at a specific rotation speed from the control circuit (control circuit configured to control the pump module), the controller may correct a received specific rotation speed using the correction information, and may drive the corresponding pump section at a corrected rotation speed. The controller may correct an actual rotation speed of the pump section using the correction information, and may output a corrected rotation speed to the control circuit.

Embodiments

Referring to FIG. 1, an internal combustion engine system 10 will be described. The internal combustion engine system 10 comprises a fuel supply system 2 and a evaporated fuel processing device 8. The internal combustion engine system 10 is mounted on a vehicle such as an automobile. The evaporated fuel processing device 8 is connected to a fuel supply system 2 that supplies fuel stored in a fuel tank FT to an engine EN.

The fuel supply system 2 supplies fuel pumped from a fuel pump (not shown) accommodated in the fuel tank FT to an injector IJ. The injector IJ comprises a solenoid valve an opening degree of which is adjusted by an ECU (Engine Control Unit) 100 (to be described later). The injector IJ injects fuel into the engine EN.

An intake pipe IP and an exhaust pipe EP are connected to the engine EN. The intake pipe IP is an example of an intake path. The intake pipe IP is a pipe for supplying air to the engine EN by negative pressure of the engine EN or operation of a turbocharger CH. A throttle valve TV is disposed in the intake pipe IP. The throttle valve TV is disposed downstream of the turbocharger CH and upstream of an intake manifold IM. An amount of air flowing into the engine EN is controlled by adjusting an opening degree of the throttle valve TV. That is, the throttle valve TV controls an intake air amount of the engine EN. The throttle valve TV is controlled by the ECU 100.

The turbocharger CH is disposed upstream of the throttle valve TV of the intake pipe IP. The turbocharger CH is a so-called turbocharger, and rotates a turbine by gas exhausted from the engine EN to the exhaust pipe EP, thereby pressurizing the air in the intake pipe IP and supplying the air to the engine EN. The turbocharger CH is controlled by the ECU 100 to operate when a rotation speed N of the engine EN exceeds a predetermined rotation speed (for example 2000 revolutions) of the engine EN.

An upstream throttle valve 54 is disposed upstream of the turbocharger CH of the intake pipe IP. The upstream throttle valve 54 controls a supply amount of intake air to the turbocharger CH. By adjusting an opening degree of the upstream throttle valve 54, pressure in the intake pipe IP between the upstream throttle valve 54 and the turbocharger CH can be controlled. That is, by adjusting the opening degree of the upstream throttle valve 54, it is possible to adjust an inside of the intake pipe IP between the upstream throttle valve 54 and the turbocharger CH to an atmospheric pressure or to negative pressure. Hereinafter, the inside of the intake pipe IP between the upstream throttle valve 54 and the turbocharger CH is referred to as a pressure control section 56. The pressure control section 56 is controlled to have an atmospheric pressure or negative pressure. The pressure control section 56 is provided with a pressure gauge 58. Detected value(s) of the pressure gauge 58 are transmitted to the ECU 100. A pressure of the pressure control section 56 is controlled by the ECU 100.

An air cleaner AC is disposed upstream of the upstream throttle valve 54 of the intake pipe IP. The air cleaner AC comprises a filter for removing foreign matter from air flowing into the intake pipe IP. In the intake pipe IP, when the throttle valve TV is opened, air passes through the air cleaner AC and is taken in toward the engine EN. The engine EN combusts fuel and air therein, and exhausts the fuel and air to the exhaust pipe EP after combustion.

The ECU 100 is connected to an air-fuel ratio sensor 50 disposed in the exhaust pipe EP. The ECU 100 detects the air-fuel ratio in the exhaust pipe EP from a detection result of the air-fuel ratio sensor 50, and controls an amount of fuel injected from the injector IJ.

The ECU 100 is connected to an air flow meter 52 disposed in vicinity of the air cleaner AC. The air flow meter 52 is a so-called hot wire type of air flow meter, but may comprise another configuration. The ECU 100 receives a signal indicative of a detected result from the air flow meter 52, and detects an amount of air supplied to the intake pipe IP (amount of air passing through the upstream throttle valve 54).

In a state in which the turbocharger CH is stopped, negative pressure is generated in the intake manifold IM by operation of the engine EN. It should be noted that, such a situation occurs in which the negative pressure in the intake manifold IM caused by the operation of the engine EN is not generated, or is small when idling of the engine EN is stopped during the automobile not running, or when the engine EN is stopped and travels by a motor as in a hybrid vehicle, in other words, when driving of the engine EN is controlled for environmental purposes. On the other hand, in a situation where the turbocharger CH is operating, a downstream side of the turbocharger CH is in positive pressure, and an upstream side of the turbocharger CH is in atmospheric pressure or negative pressure.

The evaporated fuel processing device 8 supplies evaporated fuel (purge gas) in the fuel tank FT to the engine EN via the intake pipe IP. The evaporated fuel processing device 8 comprises a canister 14, a pump 12, a gas pipe 32, a purge control valve 34, and a pressure gauge 30. The gas pipe 32 is an example of a purge path. The canister 14 adsorbs evaporated fuel generated in the fuel tank FT. The canister 14 comprises activated carbon 14*d* and a case 14*e* housing the activated carbon 14*d*. The case 14*e* has a tank port 14*a*, a purge port 14*b*, and an atmosphere port 14*c*. The tank port 14*a* is connected to an upper end of the fuel tank FT. Due to this, evaporated fuel in the fuel tank FT flows into the canister 14. The activated carbon 14*d* adsorbs evaporated fuel from the gas flowing into the case 14*e* from the fuel tank FT. Due to this, it is possible to prevent evaporated fuel from being discharged to an atmosphere.

The atmosphere port 14*c* communicates with the gas pipe 20. The gas pipe 20 is an atmospheric path, and one end thereof is opened to the atmosphere. An air filter AF is disposed on the gas pipe 20. The atmosphere port 14*c* communicates with the atmosphere via the air filter AF. The air filter AF removes foreign matter from the air flowing into the canister 14 via the atmosphere port 14*c*.

The purge port 14*b* communicates with the gas pipe 32. The gas pipe 32 includes a first hose 22 and a second hose 26. The first hose 22 connects the canister 14 and the pump 12, and the second hose 26 connects the pump 12 and the intake pipe IP. The second hose 26 (gas pipe 32) is connected to the intake pipe IP between the upstream throttle valve 54 and the turbocharger CH. That is, the second hose 26 is connected to the pressure control section 56. The first and second hoses 22 and 26 are made of a flexible material such as rubber or resin.

Purge gas in the canister 14 flows from the canister 14 into the first hose 22 via the purge port 14*b*. The purge gas in the first hose 22 is supplied through the pump 12, the purge control valve 34, and the second hose 26 into the intake pipe IP (pressure control section 56) upstream of the turbocharger CH.

The pump 12 is disposed between the canister 14 and the intake pipe IP. The pump 12 is a so-called vortex pump (also called a cascade pump, a wesco pump) or a centrifugal pump. The pump 12 is controlled by the ECU 100. An inlet of the pump 12 communicates with the canister 14 via the first hose 22.

An outlet of the pump 12 is connected to the second hose 26. The purge control valve 34 is provided on the second hose 26. The second hose 26 is connected to the intake pipe IP.

The purge control valve 34 is disposed on the second hose 26. When the purge control valve 34 is closed, the purge gas is stopped by the purge control valve 34 and does not flow to the second hose 26. On the other hand, when the purge control valve 34 is opened, the purge gas passes through the second hose 26 and flows into the intake pipe IP. The purge control valve 34 is an electronic control valve and is controlled by the ECU 100.

The pressure gauge 30 is disposed on the second hose 26. The pressure gauge 30 is disposed between the pump 12 and the purge control valve 34. Pressure loss of the purge control valve 34 can be measured by the pressure gauge 30 and the pressure gauge 58. The pressure loss of the purge control valve 34 changes along with a change in a flow rate of the purge gas passing through the purge control valve 34. Specifically, as the flow rate of the purge gas passing through the purge control valve 34 increases, the pressure loss of the purge control valve 34 increases.

The ECU 100 comprises a controller 102 that controls the internal combustion engine system 10. The controller 102 is disposed integrally with other parts of the ECU 100 (for example, a part that controls the engine EN). The controller 102 may be disposed separately from other parts of the ECU 100. The controller 102 comprises a CPU and a memory such as a ROM, a RAM or the like. The controller 102 controls the internal combustion engine system 10 in accordance with a program stored in advance in the memory. Specifically, the controller 102 outputs a signal to the pump 12 to control the pump 12. In addition, the controller 102 operates the throttle valve TV and the upstream throttle valve 54, outputs a signal to the purge control valve 34, and executes duty control. The controller 102 adjusts opening time of the purge control valve 34 by adjusting a duty ratio of the signal output to the purge control valve 34.

Figure 2:
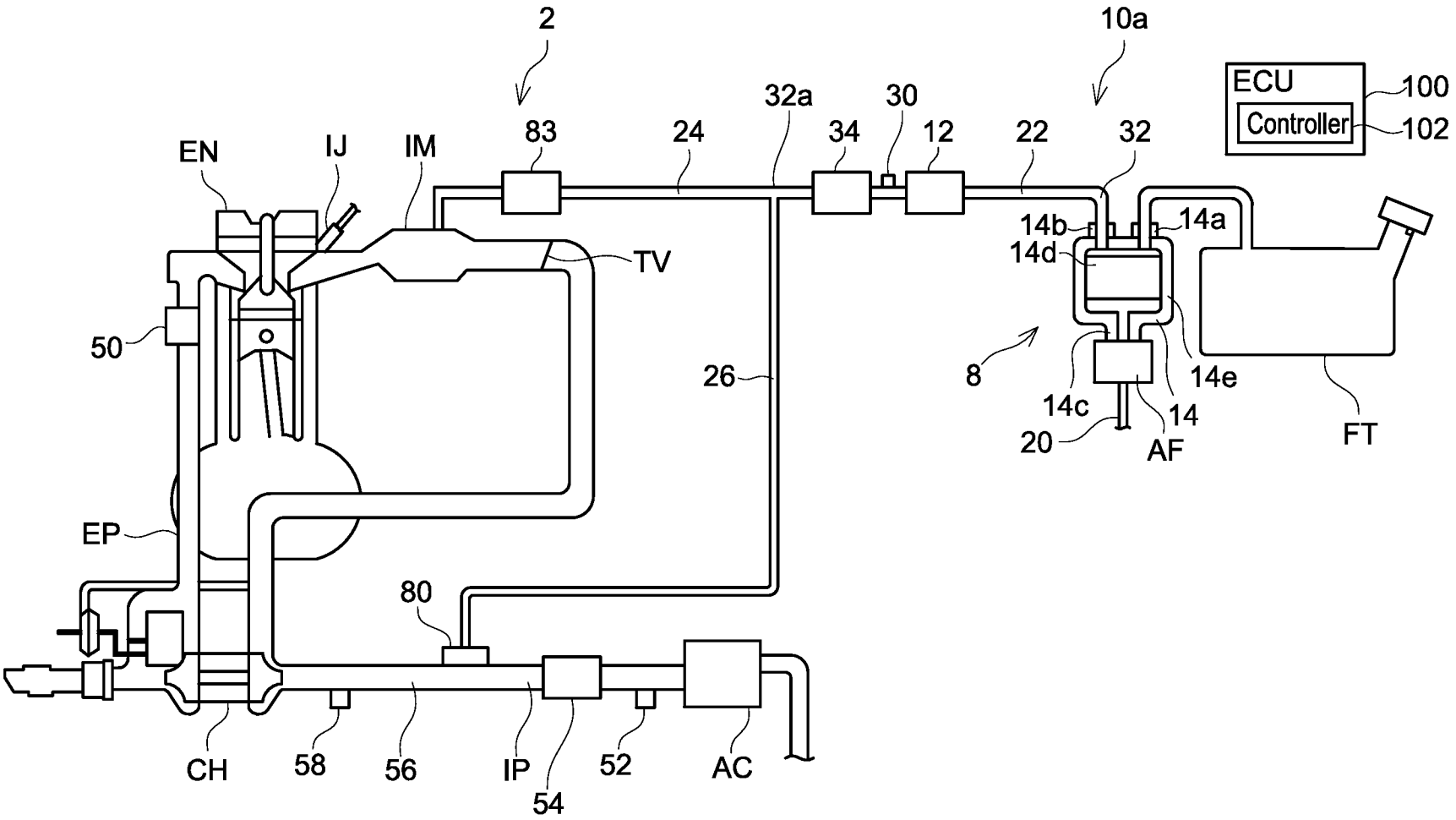
FIG. 2 shows an overview of a variation of an internal combustion engine system.

Referring to FIG. 2, an internal combustion engine system 10*a* will be described. The internal combustion engine system 10*a* is a modification of the internal combustion engine system 10. In the internal combustion engine system 10*a*, like reference numerals are given to like components as those of the internal combustion engine system 10, thus descriptions thereof may be omitted. In the internal combustion engine system 10*a*, a gas pipe 32 branches off into the second hose 26 and a third hose 24 at a branch point 32*a* at an intermediate position of the gas pipe 32. The second hose 26 is connected to the pressure control section 56 via a check valve 80. While the check valve 80 allows supply of gas from the second hose 26 to the intake pipe IP, the check valve 80 also prohibits supply of gas from the intake pipe IP to the second hose 26. The third hose 24 is connected to the intake pipe IP between the throttle valve TV and the engine EN. The third hose 24 is detachably connected to the intake manifold IM. A check valve 83 is disposed at an intermediate position of the third hose 24. The check valve 83 allows gas to flow through the third hose 24 toward the intake manifold IM, and prohibits the gas from flowing toward the canister 14.

In the internal combustion engine system 10*a*, when the controller 102 opens the purge control valve 34 in a state where the turbocharger CH is not operating, purge gas is supplied from the canister 14 through the first hose 22 and the third hose 24 to the intake manifold BA downstream of the turbocharger CH. At this occasion, the controller 102 executes the control of driving or stopping the pump 12 in accordance with a state of negative pressure of the intake manifold IM (for example, the rotation speed of the engine EN).

When the state of the turbocharger CH shifts from not operating to operating, the purge gas is supplied from the canister 14 through the first hose 22 and the second hose 26 to the intake pipe IP upstream of the turbocharger CH. At this occasion, when the inside of the intake pipe IP (the pressure control section 56) is controlled to atmospheric pressure, the controller 102 may drive the pump 12 to send out the purge gas. Due to this, the purge gas does not need to be supplied to the intake manifold IM downstream of the turbocharger CH, which has positive pressure, in a state where the turbocharger CH is operating.

On the other hand, when the state of the turbocharger shifts from operating to not operating, the purge gas is supplied from the canister 14 through the first hose 22 and the third hose 24 to the intake manifold IM.

Figure 3:
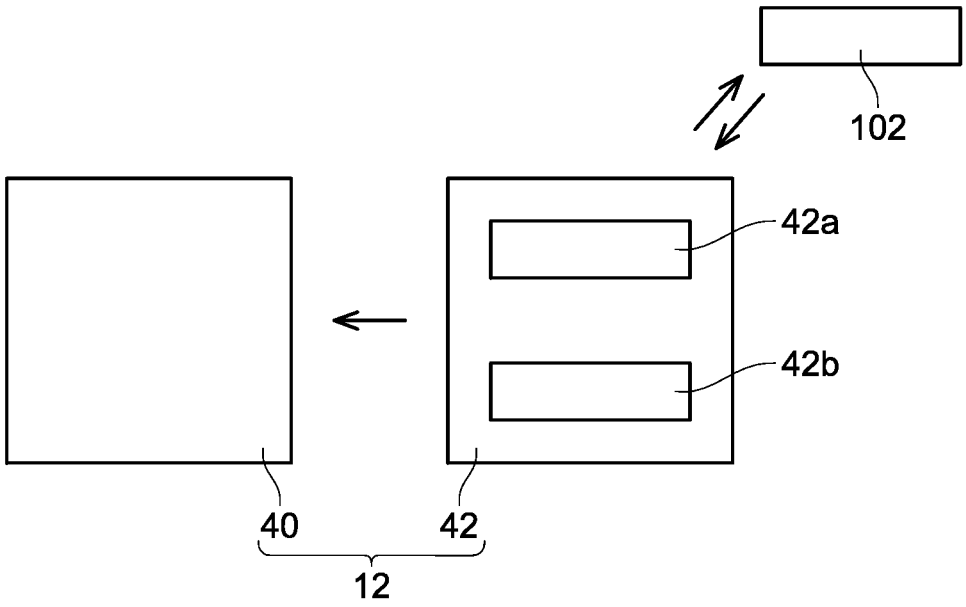
FIG. 3 shows a configuration of a pump module comprising a pump circuit section.

The pump 12 will be described below with reference to FIG. 3. The pump 12 comprises a pump section 40 that performs mechanical operation, and a pump circuit section 42 that drives the pump section 40. The pump 12 is a pump module comprising the pump section 40 and the pump circuit section 42. The pump section 40 is connected to the gas pipe 32 (see also FIGS. 1 and 2). The pump circuit section 42 is attached to the pump section 40. The pump circuit section 42 comprises a storage 42*a* and a controller 42*b*. The pump circuit section 42 is communicatively coupled to the controller 102 of the ECU 100 (see also FIGS. 1 and 2). The pump circuit section 42 controls the rotation speed of the pump section 40 by an output signal from the controller 102, and outputs an actual rotation speed of the pump section 40 to the controller 102. Detailed descriptions of this will be later, but the pump circuit section 42 corrects the output signal (driving rotation speed) from the controller 102 to drive the pump section 40, and corrects the actual rotation speed of the pump section 40 to output to the controller 102.

As described above, the pump 12 is controlled by an output signal from the controller 102. Specifically, in order to supply a predetermined amount (for example, a discharge amount A1 L/min) of the purge gas to the engine EN, the controller 102 outputs a signal that causes the pump 12 to rotate at a predetermined rotation speed (for example, a rotation speed X1 rpm). That is, the controller 102 outputs a signal for driving the pump section 40 at the rotation speed X1 on an assumption that the pump 12 (pump section 40) normally has a discharge performance of supplying the discharge amount A1 (L/min) of the purge gas to the engine EN when the pump 12 (pump section 40) is driven at the rotation speed X1 (rpm).

However, there are cases where A1 (L/min) of the purge gas is not discharged even if the pump section 40 is driven at the rotation speed X1 due to individual difference (performance difference) of pump sections 40. In the pump 12, the controller 42*b* corrects the rotation speed X1 from the controller 102 according to the discharge characteristic of the pump section 40 stored in the storage 42*a*, and drives the pump section 40 at a corrected, controlled rotation speed, thereby supplying a desired amount of the purge gas to the engine EN. More specifically, when the controller 42*b* receives a signal for driving the pump 12 at the rotation speed X1 from the controller 102, the controller 42*b* drives the pump 12 at a rotation speed X2, which differs from the rotation speed X1, based on correction information of the pump section 40 stored in the storage 42*a*, and supplies the desired discharge amount A1 (L/min) of the purge gas to the engine EN.

First Embodiment

The correction information of the first embodiment will be described with reference to FIGS. 4 to 6. In the present embodiment, as the correction information, the storage 42*a* stores a discharge amount correction coefficient indicated as a ratio between a reference discharge amount of a reference pump section at a predetermined rotation speed and a discharge amount of a corresponding pump section at the predetermined rotation speed. The correction information is obtained by actually measuring a characteristic of the corresponding pump section 40.

Figure 4:
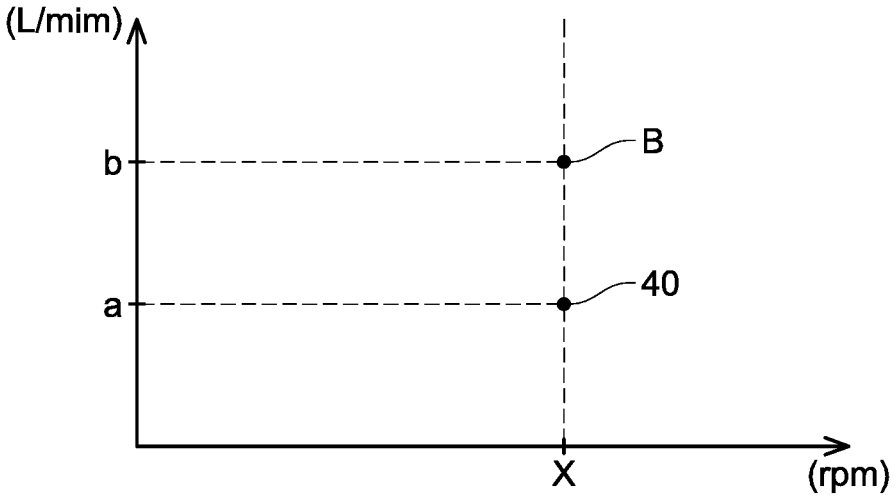
FIG. 4 is a diagram for explaining correction information of a first embodiment.
Figure 5:
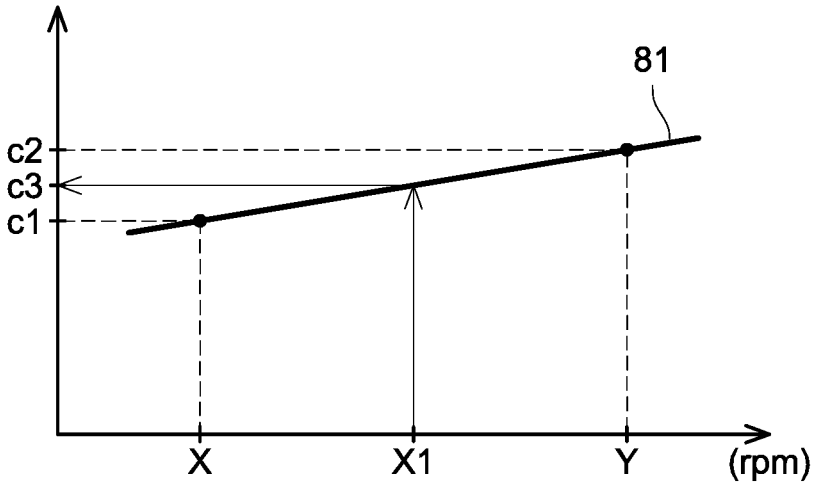
FIG. 5 is a diagram for explaining the correction information of the first embodiment.

FIG. 4 shows a discharge amount of the pump section 40 (discharge characteristic of the pump section 40: L/min) and a discharge amount of a reference pump section B (reference discharge characteristic) when the pump sections are rotated at a rotation speed X. As shown in FIG. 4, when driven at the rotation speed X, the pump section 40 has a discharge amount a, whereas the reference pump section B has a discharge amount b. The discharge characteristic of the pump section 40 differs from the reference discharge characteristic of the reference pump section B. The discharge amount correction coefficient of the pump section 40 is obtained by a discharge ratio c "c=a/b" of the discharge amount a of the pump section 40 to the discharge amount b of the reference pump section B. The storage 42*a* stores the discharge ratio c as the correction information.

Here, the reference discharge characteristic will be described. The reference discharge characteristic refers to a performance of a pump section by which if a normal pump section is driven at a predetermined rotation speed, the pump section discharges a specific amount of purge gas, and is, for example, a target value (desired value) assumed when the pump section was designed. In this case, the reference pump section is a virtual pump section that operates as designed (intended). Alternatively, the reference discharge characteristic is a reference value (e.g., a mean value, a median value, or a mode value) determined by measuring the discharge characteristics of all the pump sections manufactured in a certain period (or in a certain lot). In this case, the reference pump section is a virtual pump section having a determined reference value.

As described above, the storage 42*a* stores the discharge ratio (discharge amount correction coefficient) c of the corresponding pump section 40. In the pump circuit section 42, the controller 42*b* drives the pump section 40 at a rotation speed different from the rotation speed received from the controller 102 in accordance with the discharge ratio c stored in the storage 42*a*. For example, when the controller 42*b* receives a signal for driving the pump 12 at the rotation speed X1 from the controller 102, the controller 42*b* drives the pump section 40 at the rotation speed X2 (X2=X1/c) obtained by dividing the rotation speed X1 by the discharge ratio c. This makes it possible to supply the same amount of purge gas to the engine EN as when the reference pump section B is driven at the rotation speed X1.

The discharge ratio c may differ depending on a rotation speed of a pump section. Therefore, the storage 42*a* may store a plurality of discharge ratios c. FIG. 5 shows a discharge ratio c1 of the pump section 40 at the rotation speed X and a discharge ratio c2 of the pump section 40 at a rotation speed Y. As shown in FIG. 5, the discharge ratios differ between the rotation speed X and the rotation speed Y. In this case, if a plurality of discharge ratios c (c1, c2) are stored, a function (discharge amount correction function) 81 based on the rotation speed and the discharge ratios c can be created, and a discharge ratio c3 at the rotation speed X1 can be calculated. A desired amount of purge gas can be supplied to the engine EN more accurately. The storage 42*a* may store the function 81 itself.

Figure 6:
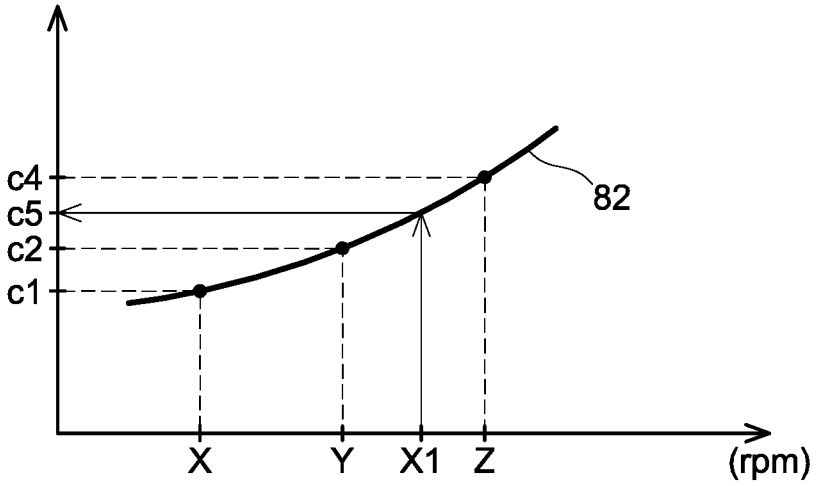
FIG. 6 is a diagram for explaining the correction information of the first embodiment.

As shown in FIG. 6, the storage 42*a* may store a correction coefficient c1 of the pump section 40 at the rotation speed X, the discharge ratio c2 of the pump section 40 at the rotation speed Y, and a discharge ratio c4 of the pump section 40 at a rotation speed Z. Due to this, a function 82 based on the rotation speeds and the discharge ratios c can be created, and a correction coefficient c5 at the time of the rotation speed X1 can be calculated. The storage 42*a* may store the function 82 itself. The storage 42*a* may store the discharge ratios c of the pump section 40 at four or more of rotation speeds, or may store a function created from four or more of the discharge ratios c.

Here, referring to FIG. 3, the operation of the pump (pump module) 12 when a signal for driving the pump section 40 at the rotation speed X is received from the controller 102 will be described. When receiving a signal for driving the pump section 40 at the rotation speed X1 from the controller 102, the controller 42*b* computes a discharge ratio c3 at the rotation speed X1 based on the correction information (discharge ratios c) stored in the storage 42*a* (see also FIG. 5). The controller 42*b* calculates a rotation speed X2 (X2=X1/c3) at which the pump section 40 is to be actually driven based on the discharge ratio c3, and drives the pump section 40 at the rotation speed X2. Due to this, the pump section 40 can supply the same amount of purge gas to the engine EN as when the reference pump section is driven at the rotation speed X1.

Further, the pump circuit section 42 detects the rotation speed of the pump section 40 when the pump section 40 operates, and outputs a value obtained by correcting the detected rotation speed with the correction information (discharge ratios c) to the ECU 100 (controller 102). For example, when the pump circuit section 42 (controller 42*b*) drives the pump section 40 at the rotation speed X2 and the pump section 40 is actually driven at a rotation speed X3, the controller 42*b* outputs a rotation speed X4 (X4=X3×c) obtained by multiplying the rotation speed X3 by the discharge ratios c to the ECU 100. The ECU 100 compares the rotation speed X4 with the rotation speed X2, and determines whether or not an anomaly has occurred in the pump section 40. It can be avoided that the ECU 100 determines that the pump section 40 has failed based on the actual rotation speed X3 of the pump section 40.

Second Embodiment

Correction information of the second embodiment will be described with reference to FIG. 7. In the present embodiment, the storage 42*a* stores, as the correction information, a reference discharge amount of a reference pump section and a discharge amount of a corresponding pump section. More specifically, the storage 42*a* stores a discharge amount group including reference discharge amounts (b1, b2) of a reference pump section B at a plurality of predetermined rotation speeds (X, Y) for calculating a reference discharge amount b3 of the reference pump section B at a specific rotation speed X1, and discharge amounts (a1, a2) of the pump section 40 at the plurality of predetermined rotation speeds (X, Y) for calculating a discharge amount a3 of the pump section 40 at the specific rotation speed X1.

Figure 7:
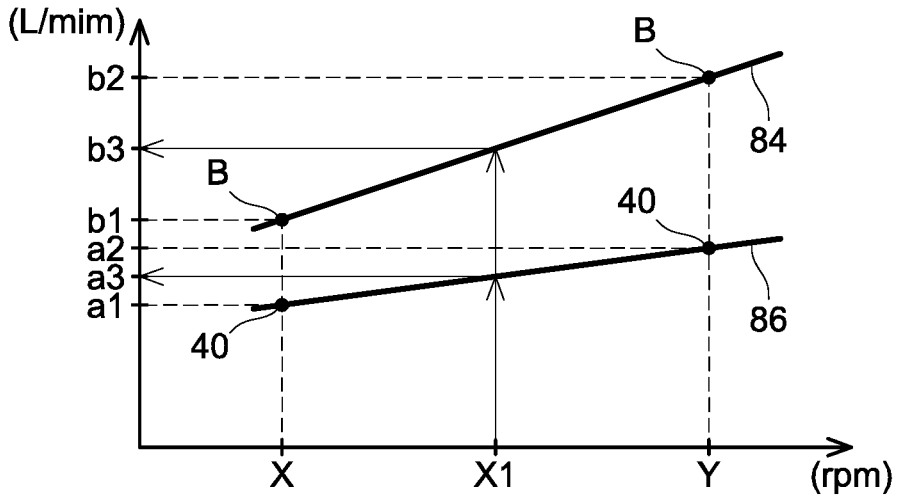
FIG. 7 is a diagram for explaining correction information of a second embodiment.

FIG. 7 shows a discharge amount a1 of the pump section 40 when the pump section 40 is rotated at a rotation speed X, a discharge amount b1 of the reference pump section B when the reference pump section B is rotated at the rotation speed X, a discharge amount a2 of the pump section 40 when the pump section 40 is rotated at a rotation speed Y, and a discharge amount b2 of the reference pump section B when the reference pump section B is rotated at the rotation speed Y. The discharge amounts a1 and b1 are substantially the same as the discharge amounts a and b described with reference to FIG. 4. The storage 42*a* stores the discharge amounts a1, a2, b1, and b2 as the correction information.

When the controller 42*b* receives a signal for driving the pump section 40 at a rotation speed X1, the controller 42*b* creates a function (discharge amount function) 86 to calculate a discharge amount a3 of the pump section 40 at the rotation speed X1, and creates a function 84 to calculate a discharge amount b3 of the reference pump section B at the rotation speed X1. The controller 42*b* drives the pump section 40 at a rotation speed X2 (X2=X1×b3/a3) at which the pump section 40 is to be driven based on the discharge amounts a3 and b3. The pump section 40 can supply, to the engine EN, the same amount (discharge amount b3) of purge gas as when the reference pump section B is driven at the rotation speed X1. The storage 42*a* may store a function group including the functions 84 and 86.

Third Embodiment

Correction information of the third embodiment will be described with reference to FIG. 8. In the present embodiment, the storage 42*a* stores, as the correction information, corresponding rotation speeds where a rotation speed of a reference pump section for discharging a specific flow rate and a rotation speed of a corresponding pump section for discharging the specific flow rate are corresponded to each other.

Figure 8:
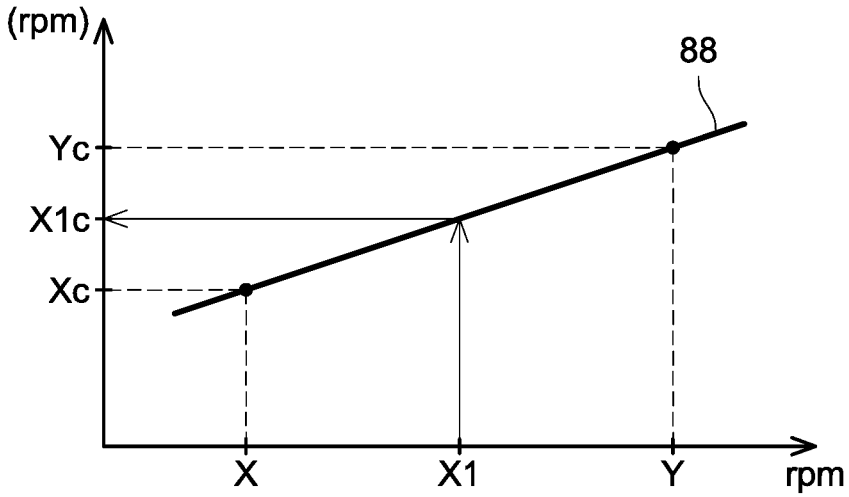
FIG. 8 is a diagram for explaining correction information of a third embodiment.

FIG. 8 shows a relationship between a rotation speed of a reference pump section B (horizontal axis) and a rotation speed of the pump section 40 (vertical axis) both for securing same discharge amounts. For example, the rotation speed of the reference pump section B for obtaining a common discharge amount a is X, and the rotation speed of the pump section 40 for obtaining the common discharge amount a is Xc. Further, the rotation speed of the reference pump section for obtaining a common discharge amount b is Y, and the rotation speed of the pump section 40 for obtaining the common discharge amount b is Yc. The storage 42*a* stores that the rotation speeds X and Xc are corresponding (corresponding rotation speeds), and that Y and Yc are the corresponding rotation speeds.

When receiving a signal for driving the pump section 40 at the rotation speed X1, the controller 42*b* creates a function (corresponding rotation speed function) 88 using the rotation speeds X, Xc, Y, and Yc, and substitutes the rotation speed X1 into the function 88 to calculate a rotation speed X1c at which the pump section 40 is to be actually driven, and drives the pump section 40 at the rotation speed X1c. In this embodiment, the rotation speed that drives the pump section 40 can be directly calculated.

Although some examples of the correction information have been described above, the correction information to be stored in the storage is not limited to those described above. In order to correct and output the rotation speed received from the ECU at the controller, the storage may store correction information based on a difference between a reference discharge characteristic at a predetermined rotation speed of the reference pump section and a discharge characteristic at the predetermined rotation speed of the pump section. Further, the discharge amount of the pump section comprises a correlation with a pump current, a shutoff pressure of the pump, and the like. Therefore, when the correction information is created, the pump current, the shutoff pressure of the pump, and the like may be measured without measuring actual discharge amount(s) of the pump section.

Figure 9:
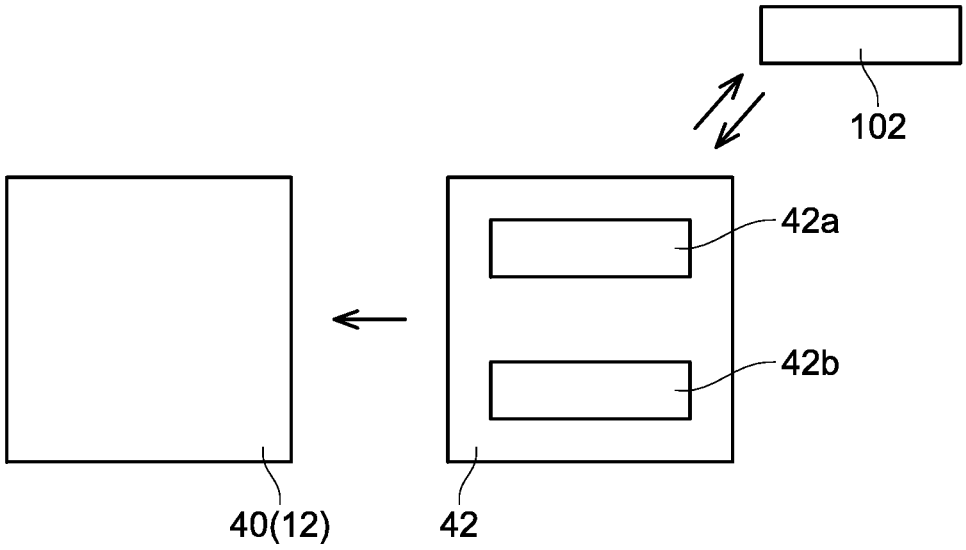
FIG. 9 is a diagram for explaining a position where a pump circuit section is provided.
Figure 10:
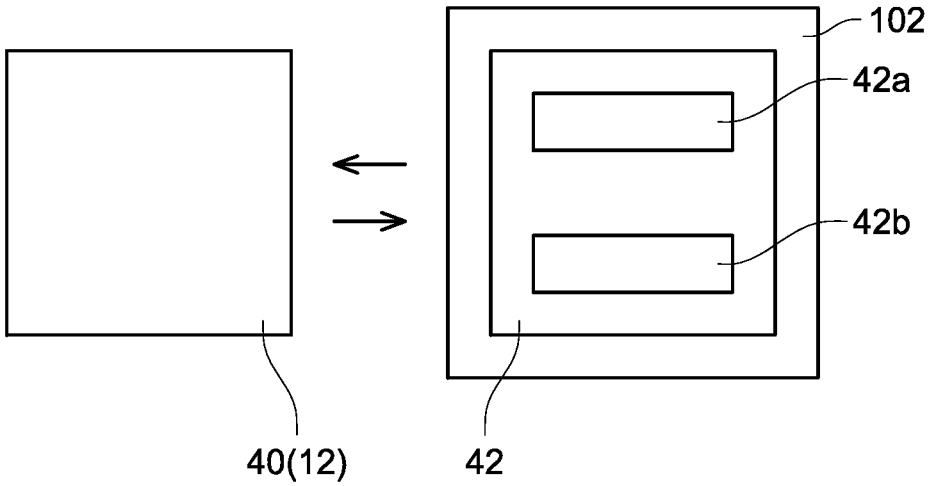
FIG. 10 is a diagram for explaining a position where the pump circuit section is provided.

Next, with reference to FIGS. 9 and 10, a position where the pump circuit section 42 is provided will be described. In FIG. 3, a pump module (pump 12) in which the pump section 40 and the pump circuit section 42 are integrated was described. That is, a configuration in which the pump circuit section 42 is a part of the pump 12 was described. However, the pump circuit section 42 may be separate from the pump section 40. FIG. 9 shows a configuration in which the pump circuit section 42 is not attached to the pump section 40. In this case, the pump 12 is constituted of only the pump section 40, and does not include the pump circuit section 42. The pump circuit section 42 exists as a pump circuit (pump control circuit) independent of the pump 12. FIG. 10 shows an example in which the pump circuit section 42 is a part of the controller 102 of the ECU 100. Also in this case, the pump 12 is constituted of only the pump section 40. In the embodiments of FIGS. 9 and 10 also, even if there is an individual difference among the pumps 12 (pump sections 40), a desired amount of purge gas can be supplied to the engine EN.

The pump module and the pump control circuit disclosed herein can also be applied to a evaporated fuel apparatus (internal combustion engine system) in a different form from the evaporated fuel processing device described above. For example, although the above internal combustion engine system includes a turbocharger, the pump module and the pump control circuit disclosed herein can be applied to an internal combustion engine system that does not include a turbocharger. In addition, although the above internal combustion engine system includes an upstream throttle valve upstream of the throttle valve (upstream of the turbocharger), the pump module and the pump control circuit disclosed herein can be applied to an internal combustion engine system that does not include an upstream throttle valve.

While specific examples of the present disclosure have been described above in detail, these examples are merely illustrative and place no limitation on the scope of the patent claims. The technology described in the patent claims also encompasses various changes and modifications to the specific examples described above. The technical elements explained in the present description or drawings provide technical utility either independently or through various combinations. The present disclosure is not limited to the combinations described at the time the claims are filed. Further, the purpose of the examples illustrated by the present description or drawings is to satisfy multiple objectives simultaneously, and satisfying any one of those objectives gives technical utility to the present disclosure.

The invention claimed is:

1. A pump module comprising:

a pump section configured to discharge evaporated fuel generated in a fuel tank to an intake path of an internal combustion engine at an evaporated fuel flow rate; and a pump circuit section comprising a storage storing correction information and configured to utilize the correction information to correct a rotation speed of the pump section, resulting in a change in the evaporated fuel flow rate to maintain a target rate, based on a difference between a reference discharge characteristic of a reference pump section at a predetermined rotation speed and a discharge characteristic of the pump section at the predetermined rotation speed.

2. The pump module according to claim 1, wherein the storage stores the correction information corresponding to each of a plurality of predetermined rotation speeds.

3. The pump module according to claim 2, wherein the storage stores a function obtained from the correction information corresponding to each of the plurality of predetermined rotation speeds.

4. The pump module according to claim 3, wherein the pump circuit section comprises a controller configured to, when receiving a signal for driving the pump section at a specific rotation speed, correct a received specific rotation speed using the correction information, and drive the pump section at a corrected rotation speed.

5. The pump module according to claim 4, wherein the pump circuit section is connected to a control circuit that controls the pump module, and corrects an actual rotation speed of the pump section using the correction information, and outputs the corrected rotation speed to the control circuit.

6. An evaporated fuel processing device comprising:

a canister configured to absorb evaporated fuel vaporized within a fuel tank;

a purge path connected between an intake path of an internal combustion engine of a vehicle and the canister and through which purge gas delivered from the canister to the internal combustion engine passes;

a control valve disposed on the purge path between the intake path and the canister, and configured to switch between a communication state in which the intake path and the canister communicate with each other and a shut-off state in which communication between the intake path and the canister is shut off; and the pump module according to claim 1 disposed on a gas flow path upstream of the control valve and configured to discharge the purge gas from the canister to the intake path.

7. A pump control circuit configured to control a pump section configured to discharge evaporated fuel generated in a fuel tank to an intake path of an internal combustion engine, the pump control circuit comprising:

a storage storing correction information with the pump control circuit configured to utilize the correction information to correct a rotation speed of the pump section, resulting in a change in the evaporated fuel flow rate to maintain a target rate, based on a difference between a reference discharge characteristic of a reference pump section at a predetermined rotation speed and a discharge characteristic of the pump section at the predetermined rotation speed; and a controller configured to correct, when receiving a signal for driving the pump section at a specific rotation speed, a received specific rotation speed using the correction information, and drive the pump section at a corrected rotation speed.

8. The pump module according to claim 1, wherein the pump circuit section comprises a controller configured to, when receiving a signal for driving the pump section at a specific rotation speed, correct a received specific rotation speed using the correction information, and drive the pump section at a corrected rotation speed.

9. The pump module according to claim 1, wherein the pump circuit section is connected to a control circuit that controls the pump module, and corrects an actual rotation speed of the pump section using the correction information, and outputs the corrected rotation speed to the control circuit.

* * * * *